US007735472B2

(12) United States Patent
Okamoto et al.

(10) Patent No.: US 7,735,472 B2
(45) Date of Patent: Jun. 15, 2010

(54) HIGH-PRESSURE FUEL SUPPLY APPARATUS AND CONTROL APPARATUS FOR INTERNAL COMBUSTION ENGINE

(75) Inventors: Takashi Okamoto, Novi, MI (US); Shinsaku Tsukada, Mito (JP); Hideharu Ehara, Yokohama (JP); Masahiro Toyohara, Hitachiohta (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/277,673

(22) Filed: Nov. 25, 2008

(65) Prior Publication Data

US 2009/0150047 A1 Jun. 11, 2009

(30) Foreign Application Priority Data

Dec. 10, 2007 (JP) ..... 2007-317828

(51) Int. Cl.
*F02M 1/00* (2006.01)
*F02N 1/00* (2006.01)

(52) U.S. Cl. ..... 123/456; 123/179.17

(58) Field of Classification Search ..... 123/456, 123/457, 179.17, 479, 198 D, 497, 516
See application file for complete search history.

(56) References Cited

U.S. PATENT DOCUMENTS 6,024,064 A * 2/2000 Kato et al. ..... 123/179.17
7,546,832 B2 * 6/2009 Okamoto et al. ..... 123/506
2004/0020281 A1 2/2004 Schilling et al.
2004/0200455 A1 10/2004 Hayakawa
2004/0237938 A1 * 12/2004 Oono et al. ..... 123/457
2005/0103312 A1 5/2005 Uchiyama
2006/0162695 A1 * 7/2006 Shibata ..... 123/446
2008/0025849 A1 * 1/2008 Okamoto et al. ..... 417/213
2009/0093942 A1 * 4/2009 Okamoto et al. ..... 701/103

FOREIGN PATENT DOCUMENTS

EP 0 764 777 A2 3/1997
JP 2004-28037 A 1/2004
JP 3836399 B2 8/2006
JP 3972823 B2 6/2007
WO WO 01/83971 A1 11/2001

* cited by examiner

*Primary Examiner*—John T Kwon
(74) *Attorney, Agent, or Firm*—Crowell & Moring LLP

(57) ABSTRACT

In an internal combustion engine provided with a high-pressure fuel pump, if the discharging rate of the high-pressure fuel pump is greater than the injection quantity of fuel injected from a injector with the high-pressure fuel pump remaining uncontrollable due to failure or the like, it is probable that the fuel pressure in a common rail unintentionally rises to affect the injector. A high-pressure fuel supply apparatus is provided to solve such a problem.

A high-pressure fuel supply apparatus according to the present invention is configured such that if the high-pressure fuel supply apparatus or a control apparatus thereof causes malfunction to increase the pressure in the common rail, the pressure in the common rail does not exceed pressure affecting the flow characteristic and spray characteristic of the injector after recovery from the malfunctioning state.

11 Claims, 14 Drawing Sheets

CONVENTIONAL EXAMPLE

PRESENT INVENTION

HIGH-PRESSURE FUEL SUPPLY APPARATUS AND CONTROL APPARATUS FOR INTERNAL COMBUSTION ENGINE

BACKGROUND OF THE INVENTION

1. Field of the Invention

The present invention relates generally to apparatuses for an internal combustion engine and particularly to a high-pressure fuel supply apparatus.

2. Description of the Related Art

Recently, in spark-ignition engines such as gasoline engines, the technologies of direct injection internal combustion engines have been developed to improve fuel consumption and emission gas performance thereof by supplying fuel under pressure by a high-pressure pump and directly injecting the pressurized fuel into a combustion chamber.

To directly injecting fuel into the combustion chamber as mentioned above, the high-pressurized fuel is handled. This needs a high-pressure fuel supply apparatus. Proposals are made for such technologies.

Japanese Patent No. 3836399 intends to provide a fuel apparatus, for an internal combustion engine, of a type including a fuel container; a fuel pump; a fuel collecting passage adapted to receive fuel supplied thereto by the fuel pump; a valve device capable of controlling pressure in the fuel collecting passage; and a fuel injection device capable of allowing fuel to reach inside a combustion chamber of the engine. This fuel apparatus is characterized by the following. The valve device is formed to be closed in a non-operative state if operation pressure in at least the fuel collecting passage is normal. The valve device includes a pre-load device, which biases a valve element in a closing direction. The pre-load device is formed so that the valve device is opened in a non-operated state if the pressure in the fuel collecting passage exceeds a prescribed value. An opening pressure of the valve device in the non-operative state is set to a level lower than a maximally allowable functional pressure of the fuel injection device.

JP-A-2004-28037 intends to provide a high-pressure fuel supply apparatus that includes a high-pressure fuel supply apparatus for supplying under pressure fuel pumped from a low-pressure fuel pump to a common rail by a high-pressure fuel pump and further supplying the pressurized fuel to an injector for directly injecting the fuel in the common rail into a combustion chamber; a pressure control valve for controlling pressure in the common rail by returning fuel to the low-pressure side when the pressure increases to a predetermined value or more; a device for detecting the pressure in the common rail; and a control apparatus for controlling the pressure in the common rail.

This high-pressure fuel supply apparatus is characterized in that when the high-pressure fuel supply apparatus or a control apparatus thereof causes malfunction so that the pressure in the common rail increases, the pressure in the common rail does not exceed the maximum possible pressure for injector opening of the injector.

Japanese patent No. 3972823 intends to provide a pressure-accumulating type fuel injection apparatus that accumulates in a common rail high-pressure fuel supplied under pressure by a fuel supply pump rotatably driven by an engine and injects and supplies the high-pressure fuel into a cylinder of the engine via an injector, and that includes a pressure safety valve that opens to suppress the fuel pressure in the common rail to a limit set pressure or lower when the fuel pressure in the common rail exceeds the limit set pressure. This fuel injection apparatus is characterized by including fuel pressure detecting means for detecting the fuel pressure in the common rail; and an engine control apparatus that controls the engine to avoid an abnormal high-pressure state occurring continuously for a predetermined time, the abnormal high-pressure state being such that the fuel pressure in the common rail detected by the fuel pressure detecting means exceeds a pump-use allowable zone affecting the lowering of reliability of the fuel supply pump or an injector-use allowable zone affecting the lowering of reliability of the injector.

SUMMARY OF THE INVENTION

Japanese Patent No. 3836399 which is a conventional technology defines the opening pressure of the valve device but gives no particular consideration to the maximum fuel pressure point of the high-pressure fuel apparatus device. In addition, the maximally allowable functional pressure is defined as the pressure where fuel leaks from the fuel injection device.

JP-A-2004-28037 defines the maximum fuel pressure point encountered when the high-pressure fuel apparatus causes malfunction, as the maximum possible pressure for injector opening or lower of the injector. However, today's direct-injection internal combustion engines need a large amount of discharge and high fuel pressure. If an internal combustion engine provided with a high-pressure fuel pump dealing with a large amount of discharge and high fuel pressure intends to satisfy the definition, the pressure control valve is enlarged for controlling the pressure in the common rail when the pressure increases to a predetermined value or more. This may poses a problem in that the pressure control valve cannot be mounted on an automobile or is increased in weight. Consequently, the above-mentioned definition may probably be not established.

Japanese Patent No. 3972823 assumes a zone equal to or lower than the pressure control valve opening-pressure. Japanese Patent No. 3972823 gives no particular consideration to the maximum fuel pressure point of the high-pressure fuel apparatus device but aims to provide means for avoiding the abnormal high-pressure state.

The present inventor considers the following. An apparatus prevents a pressure control valve from increasing in size and is such that the maximum fuel pressure point of an common rail exceeds the limit pressure of an injector when a high-pressure fuel apparatus device causes malfunction. In this apparatus, the maximum fuel pressure point encountered when malfunction occurs should not be determined from reliability degradation pressure of a apparatus-constituent part. In contrast, the maximum fuel pressure point should be set from pressure that does not affect a flow characteristic (energization time—injection quantity characteristic) and a spray characteristic (spray shape and a spray angle) when malfunction of the injector is corrected after the experience of an abnormal pressure rising.

The flow and spray characteristics of the injector are parameters having a large influence on the combustion state of the direct injection internal combustion engine. The flow and spray characteristics of the injector may deviate from design values. In such a case, it is probable that the amount of fuel supplied into a combustion chamber differs from a demanded value so that the air-fuel ratio of the mixture deviates from an appropriate value. In addition, it is probable that the mixture does not concentrate close to an ignition plug so that ignition performance deteriorates to cause misfiring. If the deviation of air-fuel ratio or misfiring occurs, then fuel consumption, exhaust, or operability may deteriorate.

In view of the foregoing, the present invention has been made and it is an object of the present invention to provide a high-pressure fuel supply apparatus and a control apparatus in which the maximum fuel pressure point of a common rail encountered when a high-pressure fuel apparatus device causes malfunction exceeds a limit pressure of an injector and which does not affect the flow characteristic and spray characteristic of the injector after recovery from the malfunctioning state.

To achieve the object, there is provided a high-pressure fuel supply apparatus for an internal combustion engine according to the present invention. The high-pressure fuel supply apparatus includes: a high-pressure fuel supply system for supplying under pressure fuel delivered from a low-pressure fuel pump to a common rail by a high-pressure fuel pump and further supplying the pressurized fuel to an injector for directly injecting the fuel in the common rail into a combustion chamber; a pressure control valve for controlling pressure in the common rail by returning fuel to a low-pressure side when the pressure increases to a predetermined value or more; a apparatus for detecting the pressure in the common rail; and a control device for controlling the pressure in the common rail.

In the high-pressure fuel supply apparatus or in the control apparatus for an internal combustion engine, when the high-pressure fuel supply apparatus or a control apparatus thereof causes malfunction to increase the pressure in the common rail, a maximum pressure point in the common rail is pressure, or lower, that does not affect a flow characteristic and/or a spray characteristic of the injector after recovery from a malfunctioning state.

Preferably, the pressure that does not affect the flow characteristic and/or spray characteristic of the injector is determined based on a result of giving pressure amplitude to the injector alone.

Preferably, the maximum pressure point in the common rail is set to a maximum possible pressure for injector opening or more of the injector.

There is provided a control apparatus for an internal combustion engine according to the present invention. In the control apparatus, when the high-pressure fuel supply apparatus or the control apparatus thereof causes malfunction to increase the pressure in the common rail, injection by the injector is prohibited if the pressure in the common rail is higher than a prescribed value.

Preferably, the prescribed value is set to a lower value as engine speed of the internal combustion engine is higher.

Preferably, the prescribed value is set to a lower value as a required injection quantity of the internal combustion engine is smaller.

Preferably, when the high-pressure fuel supply apparatus or the control apparatus thereof causes malfunction to increase the pressure in the common rail, injection by the injector is prohibited at a pressure in the common rail lower than the maximum possible pressure for injector opening of the injector by a prescribed value.

Preferably, the prescribed value is calculated from engine speed of the internal combustion engine.

Preferably, the prescribed value is set to a larger value as the engine speed of the internal combustion engine is greater.

Preferably, the prescribed value is calculated from a required injection quantity of the internal combustion engine.

Preferably, the prescribed value is set to a greater value as the required injection quantity of the internal combustion engine is smaller.

The high-pressure fuel supply apparatus and the control apparatus for an internal combustion engine configured as described above according to the present invention do not change the flow characteristic and spray characteristic of the injector even after recovery from the malfunction of the apparatus while preventing enlargement of the high-pressure fuel supply apparatus. This contributes to stable combustion and to an improvement in emission gas performance.

According to the present invention, the high-pressure fuel supply apparatus and the control apparatus for an internal combustion engine do not change the flow characteristic and spray characteristic of the injector even after causing malfunction to increase the pressure and then recovering from the malfunction of the high-pressure fuel supply apparatus or the control apparatus thereof while preventing the high-pressure fuel supply apparatus from being excessively increased in size. Such a apparatus or device is provided which maintains the flow characteristic and spray characteristic of the injector significantly affecting the combustion of the direct injection internal combustion engine. This contributes to stable combustion and to an improvement in emission gas performance.

DESCRIPTION OF THE PREFERRED EMBODIMENTS

A description will hereinafter be given of embodiments of a high-pressure fuel supply apparatus according to the present invention.

Figure 1:
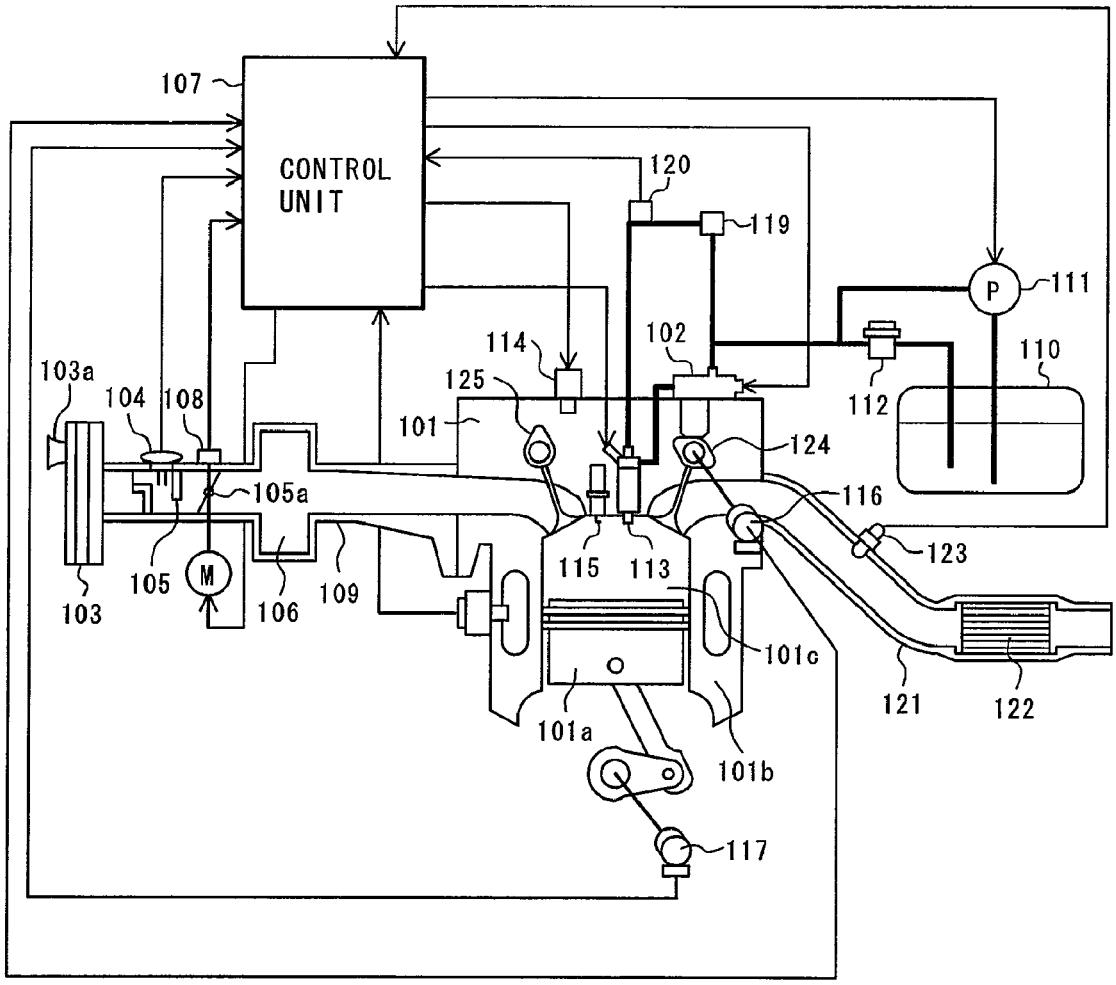
FIG. 1 is a diagram of the entire configuration of a direct injection engine control apparatus according to an embodiment of the present invention.

FIG. 1 illustrates an overall configuration of a apparatus for an internal combustion engine 101 according to the embodiment. The apparatus includes a high-pressure fuel pump 102. Intake air to be led to a cylinder 101*b* is taken from an inlet portion 103*a* of an air cleaner 103 and passes through an airflow sensor 104, one of operation state measuring means of the internal combustion engine. The intake air further passes through a throttle body 105 housing therein an electrically controlled throttle valve 105*a* for controlling intake air flow, and enters a collector 106. The airflow sensor 104 sends a signal representing the intake air flow to a control unit 107, an internal combustion engine control apparatus.

A throttle sensor 108 is attached to the throttle body 105. This throttle sensor 108 is one of the operation state measuring means of the internal combustion engine for detecting an opening angle of the throttle valve 105*a*. In addition, the throttle sensor 108 sends also a signal of the opening angle to the control unit 107.

The air sucked into the collector 106 is distributed into intake pipes 109 connected to respective cylinders 101*b* of the internal combustion engine 101 and then led to a combustion chamber 101*c* of each of the cylinders 101*b*.

On the other hand, fuel such as gasoline from a fuel tank 110 is primarily pressurized by a fuel pump 111 and regulated by a fuel pressure regulator 112 to a constant pressure (e.g. 3 $kg/cm^2$). At the same time, the fuel is secondarily pressurized by a high-pressure fuel pump 102 to higher pressure (e.g. 50 $kg/cm^2$) and led under pressure to a common rail 118. The high-pressure fuel pump 102 is driven by the rotational force of the internal combustion engine.

An injector 113, a pressure-control valve 119, and a fuel pressure sensor 120 are attached to the common rail 118. The number of the injectors 113 attached to the common rail 118 is made equal to that of cylinders of the engine. In addition, injection control is exercised in response to the signal from the control unit 107 of the engine.

Figure 6:
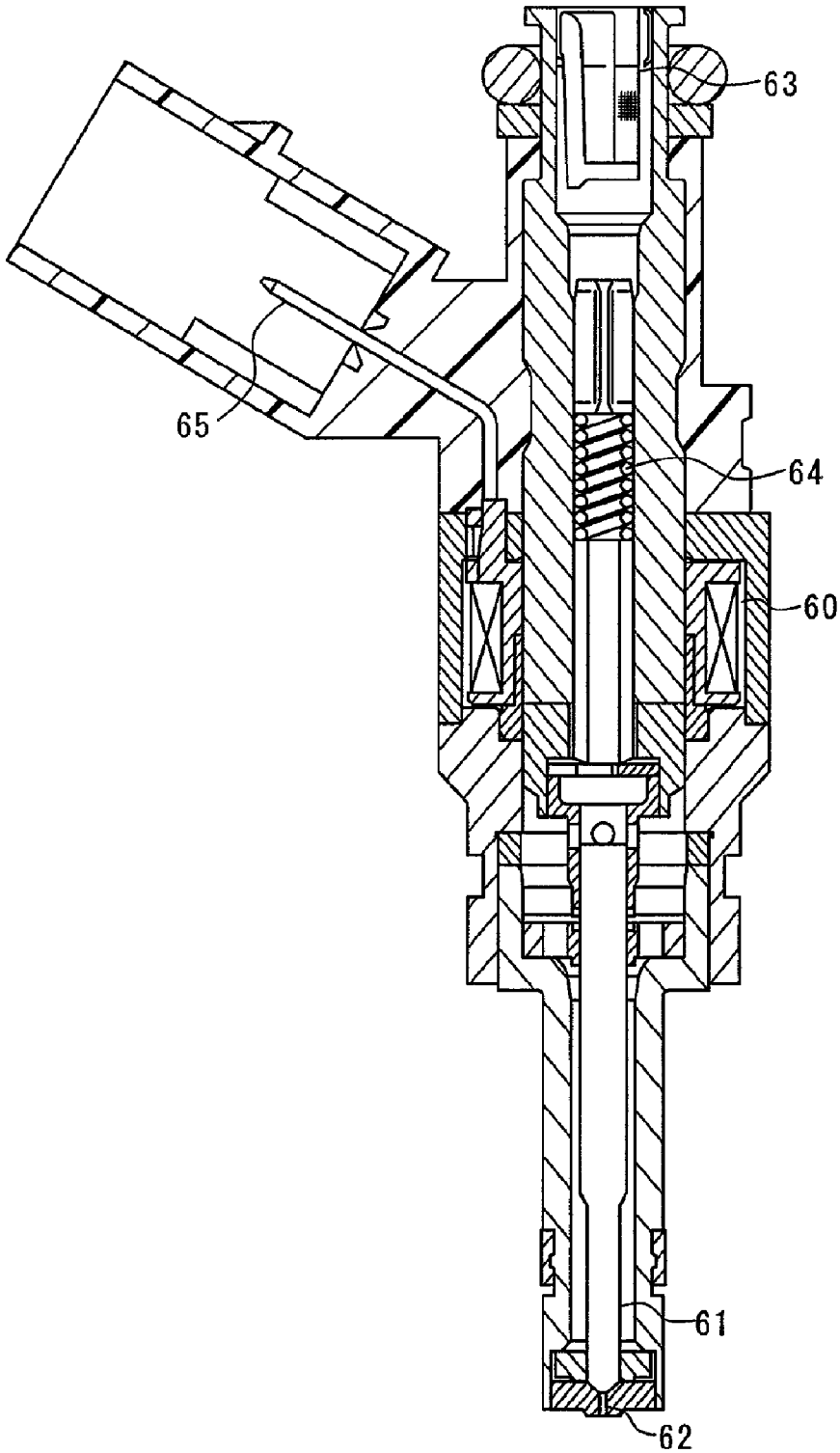
FIG. 6 illustrates an injector according to an embodiment shown in FIG. 1.

FIG. 6 is a longitudinal cross-sectional view of the injector. The injector 113 is provided with an injector electromagnetic coil 60, which is controllably energized or de-energized upon receipt of an electric signal from the control unit 107 via a pin terminal 65 of the electromagnetic coil. When the electromagnetic coil 60 is energized, an injector 61 is moved upward to open a fuel passage 62, injecting the fuel fed under pressure from an injector fuel inlet 63, into the cylinder. When electricity from the control unit 107 is cut, the electromagnetic force dissipates so that the injector 61 is closed by the force of a spring 64 biasing it in the closing direction.

When the pressure in the common rail 118 exceeds a predetermined value, the pressure-control valve 119 opens to return fuel to the low-pressure side, thus, preventing any damage to a piping apparatus.

The high-pressure fuel is injected from the injector 113 into the combustion chamber 101*c*. The fuel injected into the combustion chamber 101*c* is ignited by the ignition plug 115 in response to an ignition signal increased in voltage by an ignition coil 114.

A cam angle sensor 116 attached to a camshaft 124 of an exhaust valve outputs to the control unit 107 a signal used to detect a phase of the camshaft 124. The cam angle sensor may be attached to a intake valve side camshaft 125. A crank angle sensor 117 is attached to the crankshaft to detect the rotation and phase of the crankshaft of the engine and sends its output to the control unit 107.

An air-fuel ratio sensor 123 is provided upstream of a catalyst 122 in an exhaust pipe 121 to detect an air-fuel ratio of emission gas and sends its detection signal to the control unit 107.

Figure 2:
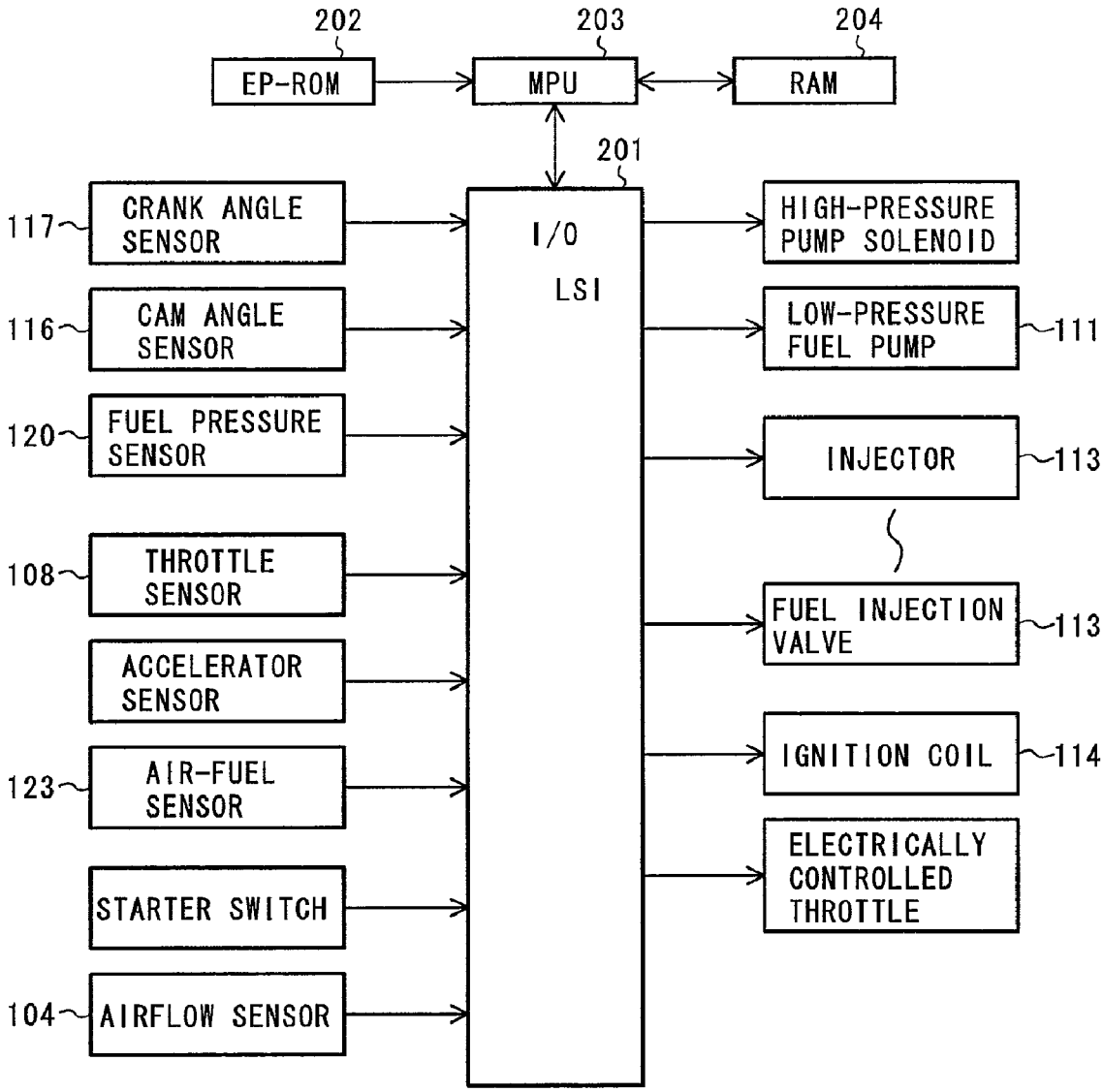
FIG. 2 is a diagram of the internal configuration of an engine control apparatus in FIG. 1.

Referring to FIG. 2, a major portion of the control unit 107 includes an MPU 203, a ROM 202, a RAM 204, and an I/O LSI 201 including an A/D converter. The major portion receives signals, as inputs, from various sensors including the airflow sensor 104, one of means for measuring (detecting) the operation state of the engine, and the fuel pressure sensor 120 and executes desired arithmetic processing. The major portion outputs various control signals calculated as a result of the arithmetic processing to the injector 113, the ignition coil 114 and the like which are control targets, thus, exercising fuel supply amount control, ignition timing control, and fuel pressure control by the fuel supply pump.

Figure 3:
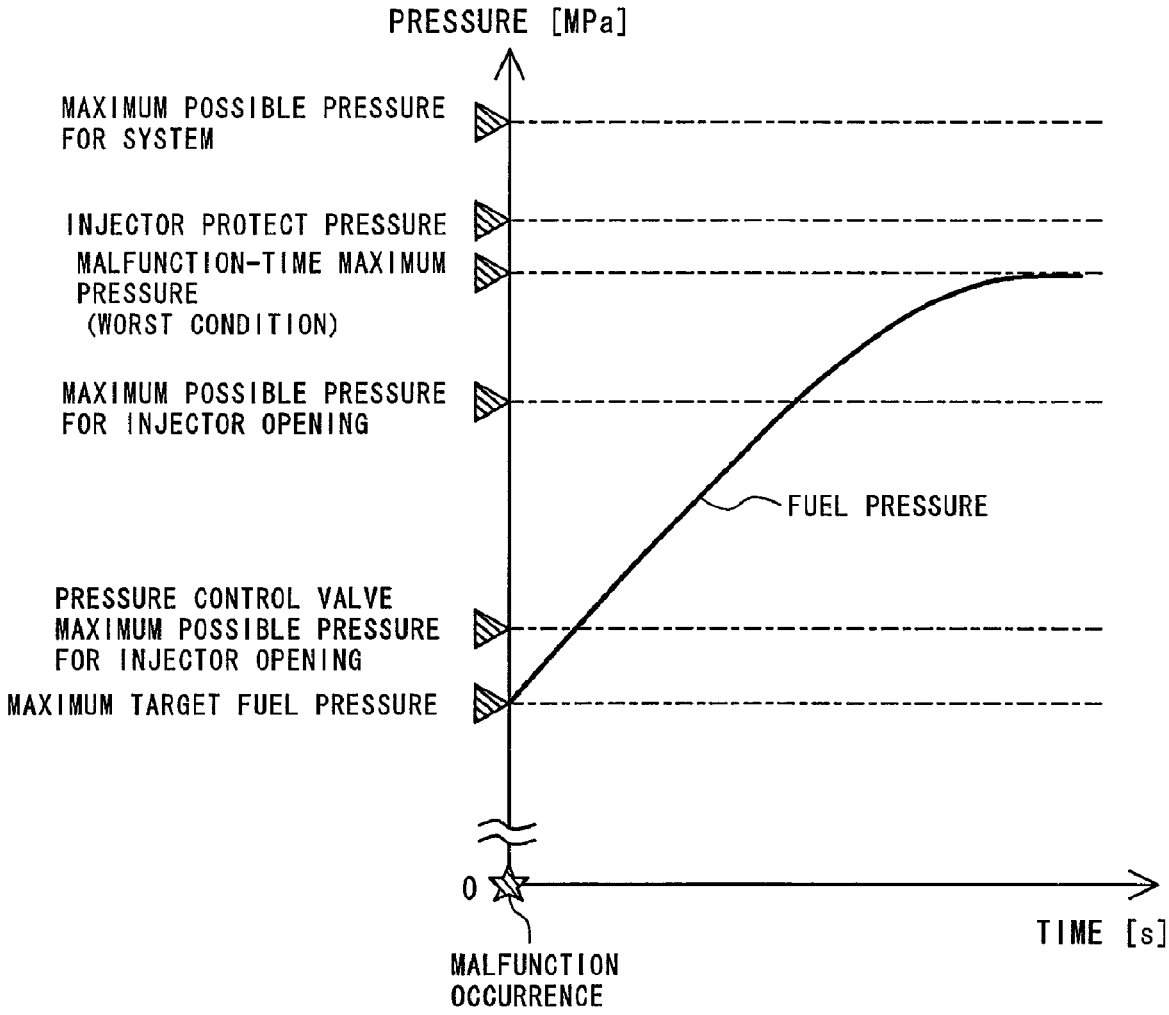
FIG. 3 illustrates fuel pressure behavior encountered when a high-pressure fuel supply apparatus or a control apparatus thereof causes malfunction, by way of example.

FIG. 3 illustrates a time chart of fuel pressure encountered when the high-pressure fuel supply apparatus or the control apparatus thereof causes malfunction so that the high-pressure fuel pump unintentionally executes full-discharge. Specifically, FIG. 3 illustrates fuel pressure behavior encountered when malfunction occurs during the maximum target pressure control in normal operation. In the event that the high-pressure fuel pump causes a full-discharge trouble, fuel pressure rises over pressure control valve opening pressure with the pressure control valve opened. This is because the pressure control valve acts as a restriction when opened.

Figure 4:
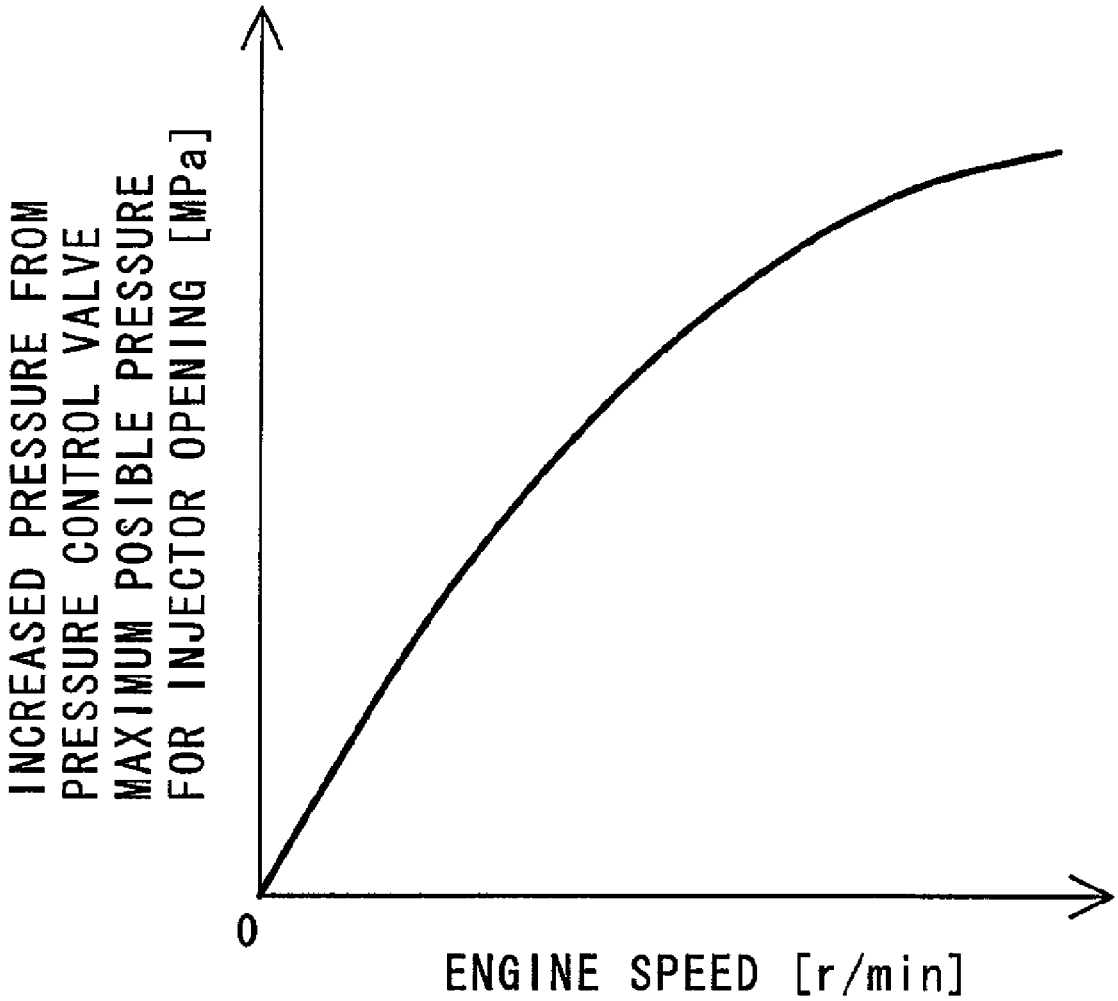
FIG. 4 illustrates the flow characteristic of a pressure control valve.

For the high-pressure fuel pump driven by the rotational force of the internal combustion engine, in the event of the full-discharge trouble, the higher the engine speed, the more the pump discharge rate is increased. Therefore, an increased width from the pressure control valve opening pressure is more increased as the engine speed is higher. (See FIG. 4.)

That is to say, the malfunction-time maximum pressure in the common rail can be defined as fuel pressure at the maximum speed of the internal combustion engine during the full-discharge trouble of the high-pressure fuel pump. The malfunction-time maximum pressure is set to an injector protect pressure or less.

The injector protect pressure is the maximum pressure that is pressure of fuel led under pressure from the injector fuel inlet 63 and that does not have an influence on the flow characteristic and spray characteristic of the injector even after the experience of the fuel pressure. The fuel pressure led under pressure from the injector fuel inlet 63 may be too high. In such a case, it is probable that the injector 61 or the like affecting the flow characteristic and spray characteristic may be deformed to affect injector characteristics (the flow characteristic and spray characteristic). The protect pressure is determined by sampling the injector characteristics obtained after the injector receives pulsating fuel fed under pressure thereto to experience a certain number of pulsations. In this case, the injector may be given a transverse load or the like corresponding to a state set in the internal combustion engine to experience pulsation. The application of pulsating fuel pressure intends to simulate the fuel pressure in the common rail of the internal combustion engine.

The maximum possible pressure for injector opening is the maximum pressure of fuel that is led under pressure from the injector fuel inlet 63, upon energization of the injector electromagnetic coil 60, to enable the upward movement of the injector 61. That is to say, if the fuel pressure exceeds the maximum possible pressure for injector opening, fuel cannot be injected. In the definitions in the present embodiment, a maximum possible pressure for injector opening variation lower limit is defined as the maximum possible pressure for injector opening.

The high-pressure fuel supply apparatus is configured to permit the malfunctioning-time maximum pressure to exceed the maximum possible pressure for injector opening. It is not necessary, therefore, to enlarge the pressure control valve, which enhances the mounting performance of the pressure control valve on a vehicle. In addition, a combination of such a apparatus with a control apparatus of the present invention described later does not affect stable combustion and emission gas performance.

It is an object of the present invention to realize stable combustion and emission gas performance even after recovery from malfunction by finding injector protect pressure lower than maximum possible pressure for apparatus which is fuel pressure where, for example, fuel leaks from the high-pressure fuel apparatus device and setting malfunctioning-time maximum fuel pressure at the protect pressure or lower.

Figure 5:
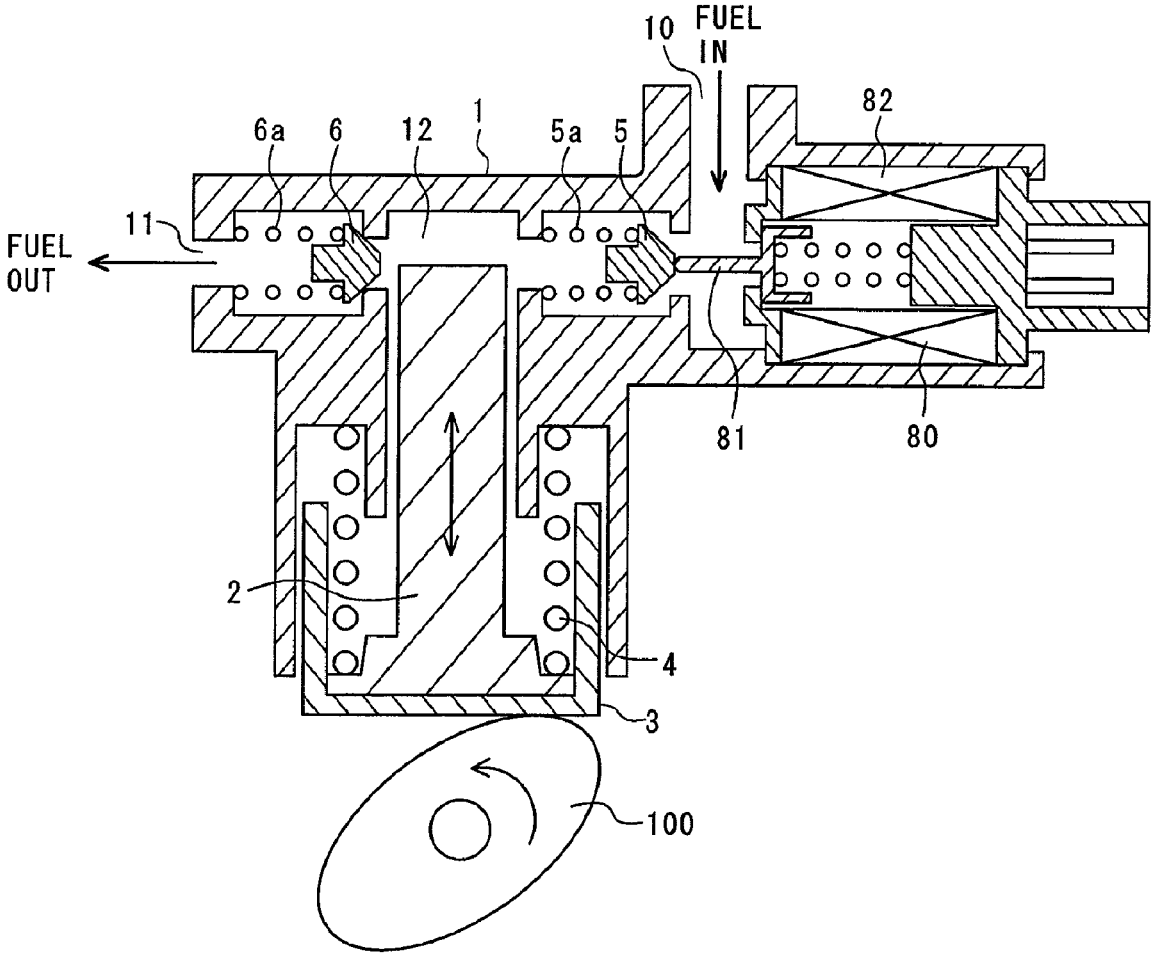
FIG. 5 illustrates a high-pressure fuel pump according to an embodiment shown in FIG. 1.

A description is next given of the control apparatus according to the embodiment. FIG. 5 illustrates a configuration of the high-pressure fuel pump by way of example. The high-pressure fuel pump 102 is formed with a fuel charging passage 10, a discharging passage 11, and a pressurized chamber 12. A plunger 2 is slidably held in the pressurized chamber 12. A intake valve 5 and a discharging valve 6 are provided in the charging passage 10 and the discharging passage 11, respectively, so as to be held in one direction by springs 5*a* and 6*a*, respectively. Thus, the intake valve 5 and the discharging valve 6 each serve as a check valve to limit a flowing direction of fuel. A solenoid 80 is held by the high-pressure fuel pump 102 and provided with an engaging member 81 and with a spring 82. The engaging member 81 is biased in the direction of opening the intake valve 5 by the spring 82 during de-energization of the solenoid 80. Since the biasing force of the spring 82 is larger than that of the intake valve spring 5*a*, the intake valve 5 is kept open during the de-energization of the solenoid 80. Fuel is led from the fuel tank 10 to the fuel inlet port of the high-pressure fuel pump 102 by the low-pressure pump 111 while regulated to a given pressure by the fuel pressure regulator 112. Thereafter, the fuel is pressurized by the high-pressure fuel pump 102 and supplied under pressure to the common rail 118 via the fuel discharging passage 11. A description is below given of operation by the configuration described above.

A lifter 3 attached to the lower end of the plunger 2 is brought into pressurized-contact with a cam 100 by a spring 4. The plunger 2 is reciprocated by the cam 100 rotated by the camshaft 124 or 125 for an intake valve or an exhaust valve, respectively, of the internal combustion engine to change the volume of the pressurized chamber 12. The intake valve 5 is closed during the compression stroke of the plunger 2 to increase the internal pressure of the pressurized chamber 12. This automatically opens the discharging valve 6 to supply fuel under pressure to the common rail 118.

Figure 7:
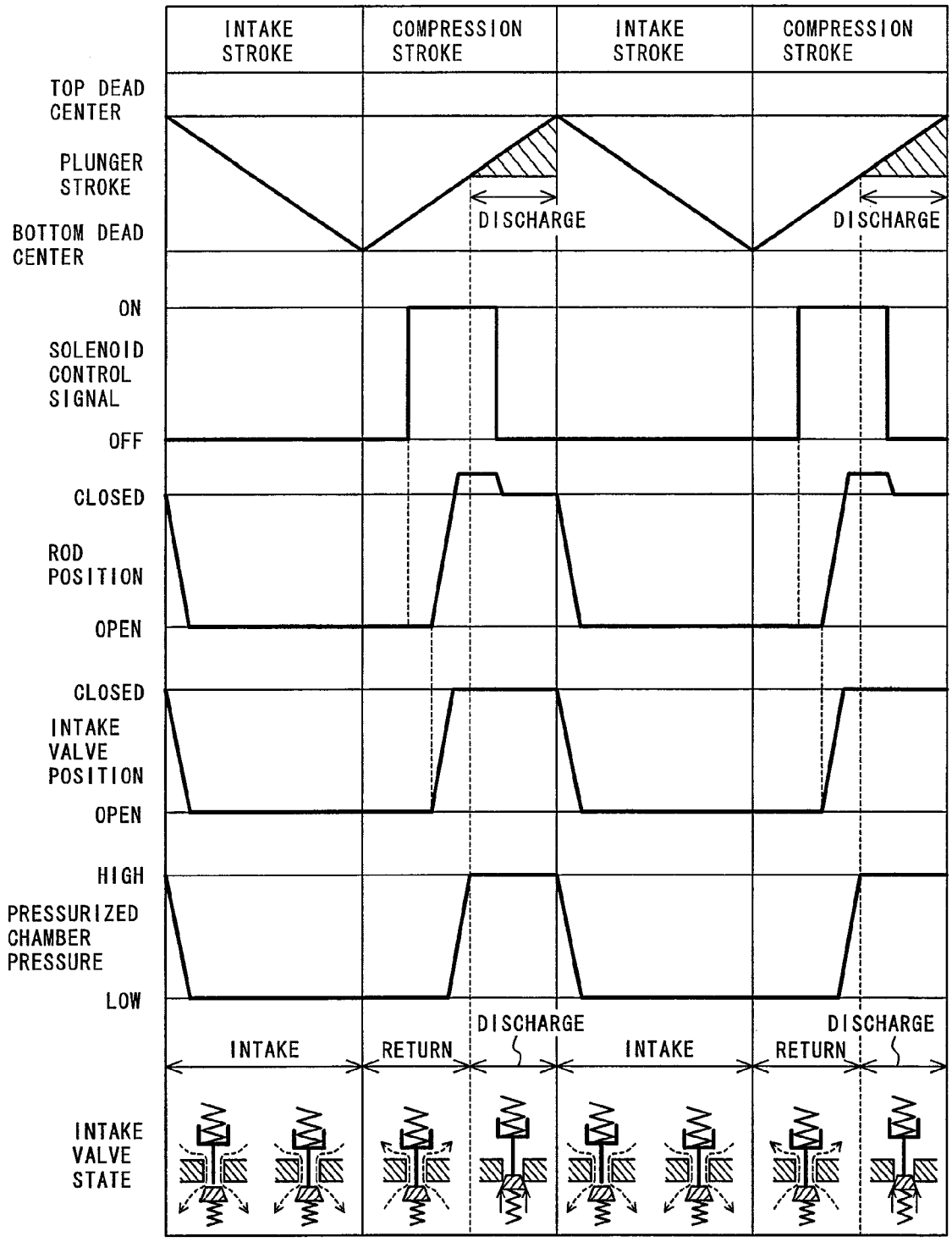
FIG. 7 is an operative diagram of the high-pressure fuel pump shown in FIG. 5.

The intake valve 5 is automatically opened if the pressure in the pressurized chamber 12 becomes lower than that at the fuel inlet port. However, closing of the intake valve 5 is determined by the operation of the solenoid 80. FIG. 7 illustrates operation encountered when the solenoid 80 is energized. When the solenoid 80 is turned on (energized), it produces an electromagnetic force not smaller than the biasing force of the spring 82 to draw the engaging member 81 toward the solenoid 202. Consequently, the engaging member 81 is isolated from the intake valve 5. In this state, the intake valve 5 acts as an automatic valve opened or closed synchronously with the reciprocation of the plunger 2. Thus, during the compression stroke, the intake valve 5 is closed and fuel according to the reduced volume of the pressurized chamber 12 presses and opens the discharging valve 6 and is supplied under pressure to the common rail 118.

Figure 8:
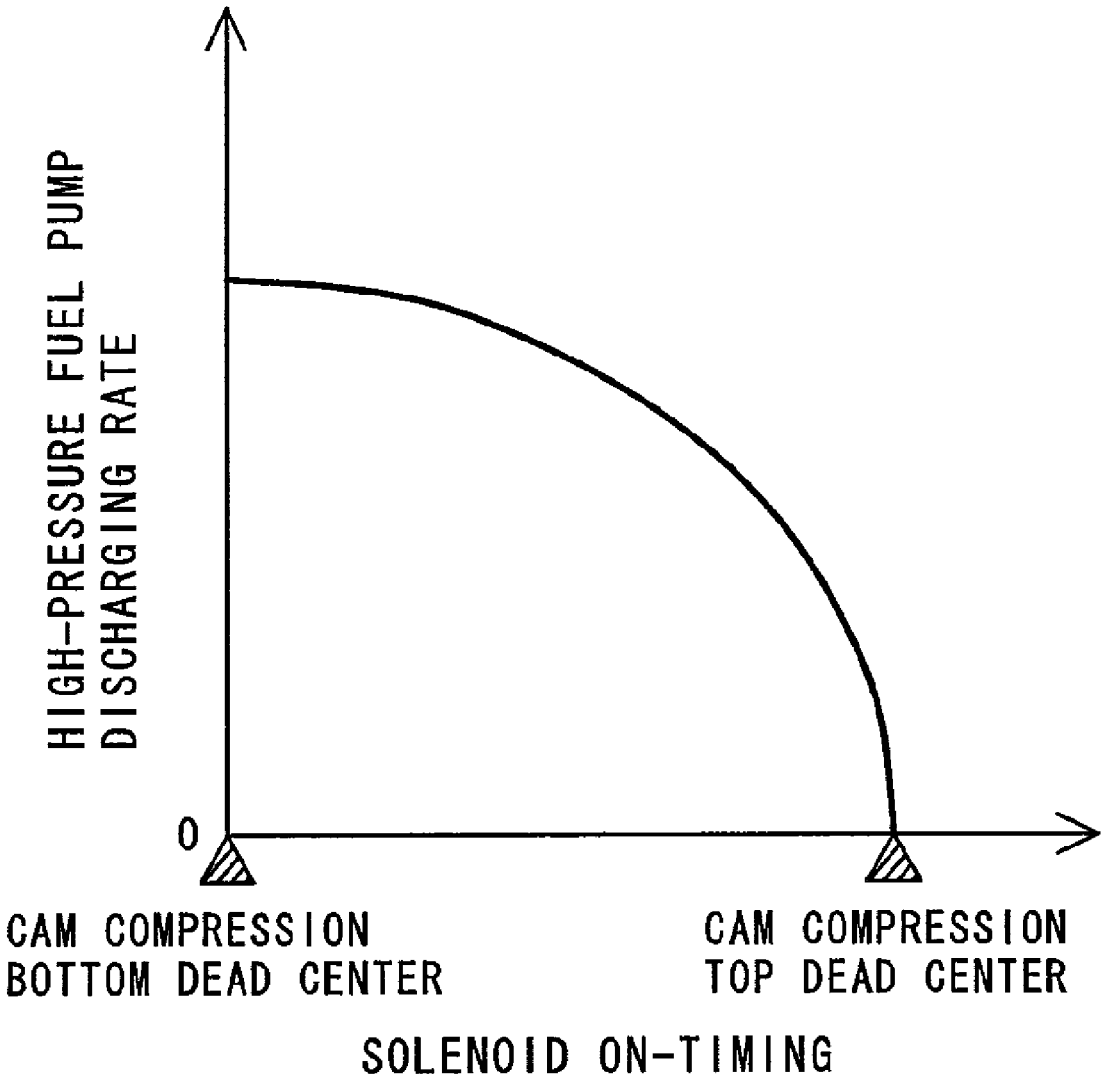
FIG. 8 is a diagram illustrating a flow characteristic of the high-pressure fuel pump.

When the solenoid 80 is turned off (de-energized), the engaging member 81 is engaged with the intake valve 5 by the biasing force of the spring 82 to maintain the intake valve 5 in an opened state. Also during the compression stroke, the pressurized chamber 12 maintains a low-pressure state generally equal to that of the fuel inlet port, so that the discharging valve 6 cannot be opened. Fuel according to the reduced volume of the pressurized chamber 12 is returned to the fuel inlet port side through the intake valve 5. Thus, the amount of fuel supplied under pressure becomes zero. On the other hand, in the middle of the compression stroke, if the solenoid 80 is brought into the ON state, fuel is supplied under pressure to the common rail 53 at that time. If fuel is once started to be supplied under pressure, the pressure in the pressurized chamber 12 rises. Even if the solenoid 80 is thereafter brought into the OFF state, the intake valve 5 is maintained in the closed state and automatically opened synchronously with the beginning of the intake stroke. FIG. 8 illustrates the relationship between a discharging rate and ON-timing of the solenoid 80 during the plunger compression stroke. The discharging rate can be adjusted by the ON-timing of the solenoid 80 during the compression stroke.

The full-discharge trouble of the high-pressure fuel pump occurs, for instance, in a case where the solenoid is continuously maintained in the ON state constantly at the bottom dead center of the cam 100 regardless of fuel pressure.

Figure 9:
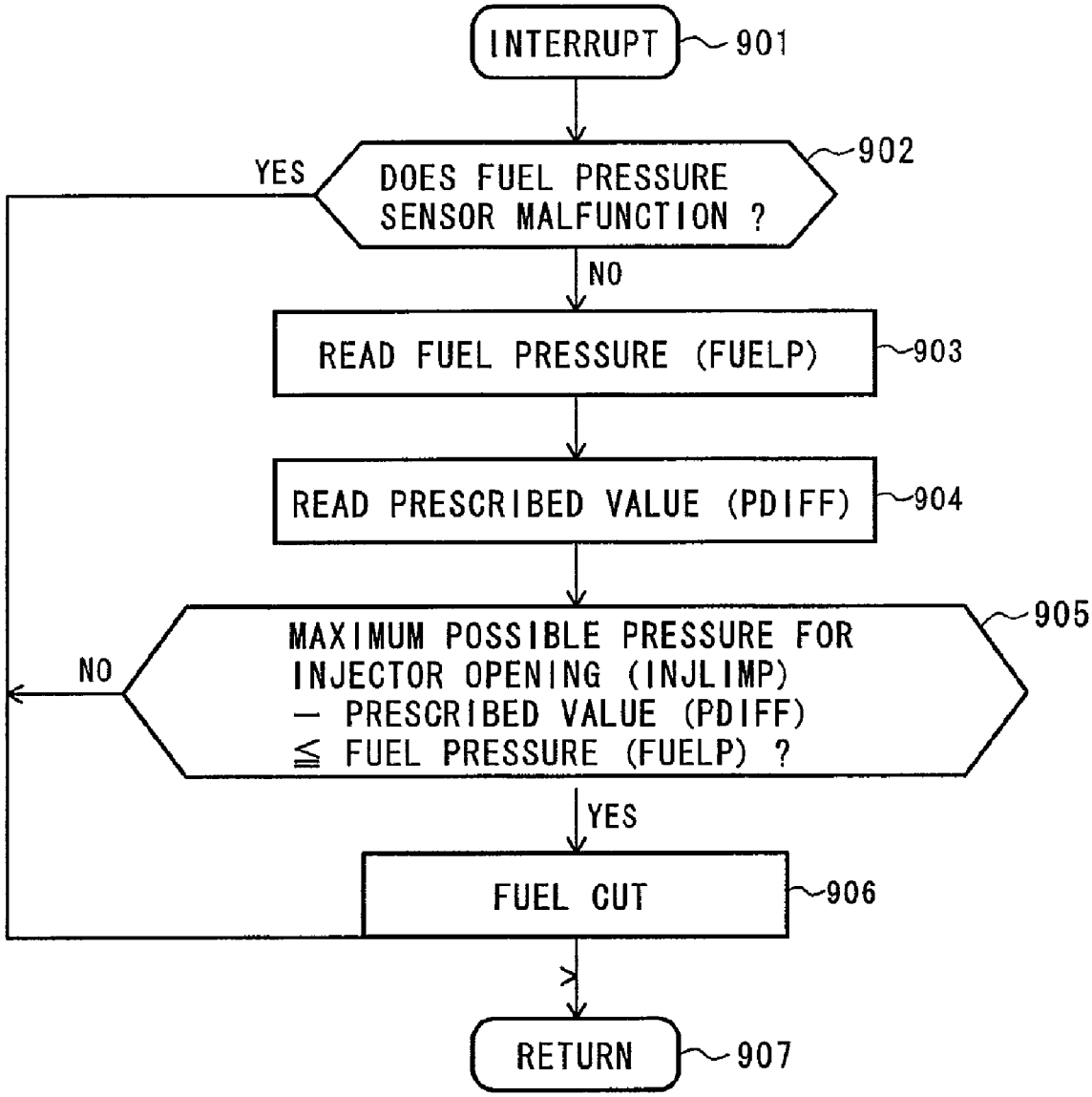
FIG. 9 is a control flowchart according to an embodiment of the present invention.

FIG. 9 illustrates a control flowchart of the control apparatus for the internal combustion engine according to the first embodiment of the present invention. Interrupt processing is started at block 901. The interrupt processing may be done based on temporal synchronization such as, e.g., every 10 ms or on a rotational period such as, e.g., every 180 degrees of crank angle.

At block 902, malfunction of a fuel pressure sensor provided in the common rail is detected. The malfunction detected at block 902 is such that the voltage of the fuel pressure sensor keeps an upper limit (fuel pressure higher than the actual fuel pressure is recognized). The malfunction is detected, for example, based on whether an input value of the fuel pressure sensor remains unchanged for a certain period of time. Block 902 aims to prevent engine stall caused by the fact that fuel pressure is erroneously recognized due to the malfunction of the fuel pressure sensor so that fuel cut relating to the present invention described later is permitted.

At block 902, if it is determined that the fuel pressure sensor is good, fuel pressure (FUELP) is read at block 903 and a prescribed value (PDIFF) is read at block 904. The prescribed value (PDIFF) is calculated by prescribed value calculation means 910. The prescribed value aims to avoid an injection quantity unstable region immediately before the maximum possible pressure for injector closing. The causes of injection quantity unstableness are two points as below.

Because of high fuel pressure, the opening and closing behavior of the injector varies.

Because of high fuel pressure, when a required injection quantity of fuel is to be injected, the opening and closing behavior of the injector varies due to too short time of energization.

Figure 10:
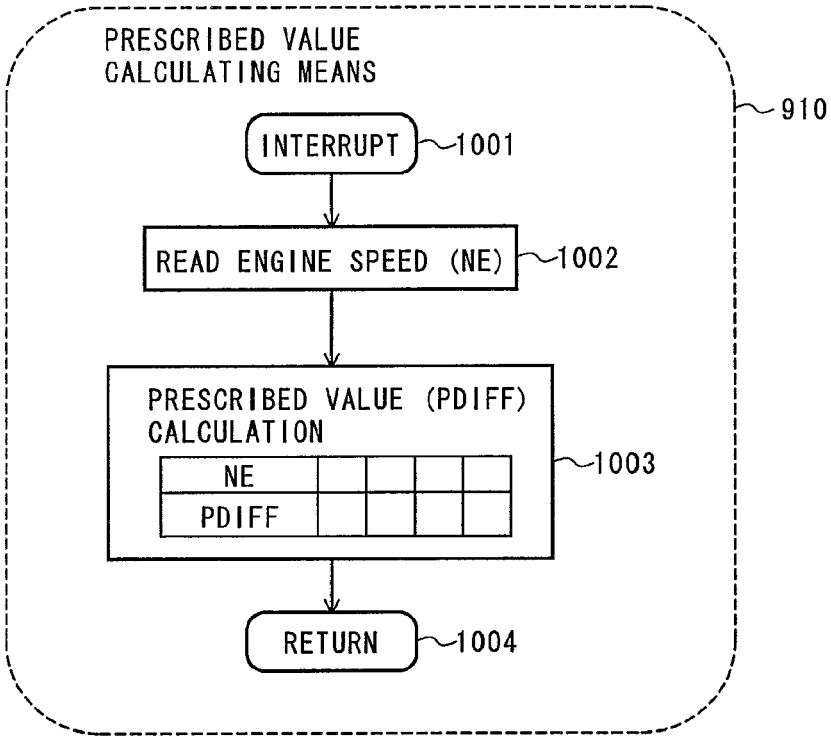
FIG. 10 is a control flowchart according to an embodiment of the present invention.

FIG. 10 illustrates a control flowchart of the prescribed value calculation means 910 according to a first embodiment. Interrupt processing is started at block 1001 and the engine speed (NE) of the internal combustion engine is read at block 1002.

Prescribed values (PDIFF) are calculated at block 1003. The prescribed values (PDIFF) are subjected to table retrieval for example. A purpose of determining the prescribed values taking engine speed as an input is to deal with the fact that fuel pressure pulsation in the common rail varies depending on engine speed and that the control unit 107 has a delay between the recognition of a fuel pressure value and the start of fuel cut. In general, during higher engine speed, fuel pressure pulsation is larger and pressure-rising speed in the delay until the start of the fuel cut is faster. Thus, the injection quantity unstable region immediately before the maximum possible pressure for injector closing can reliably be avoided by setting the prescribed values (PDIFF) at larger values with the higher engine speed.

Figure 11:
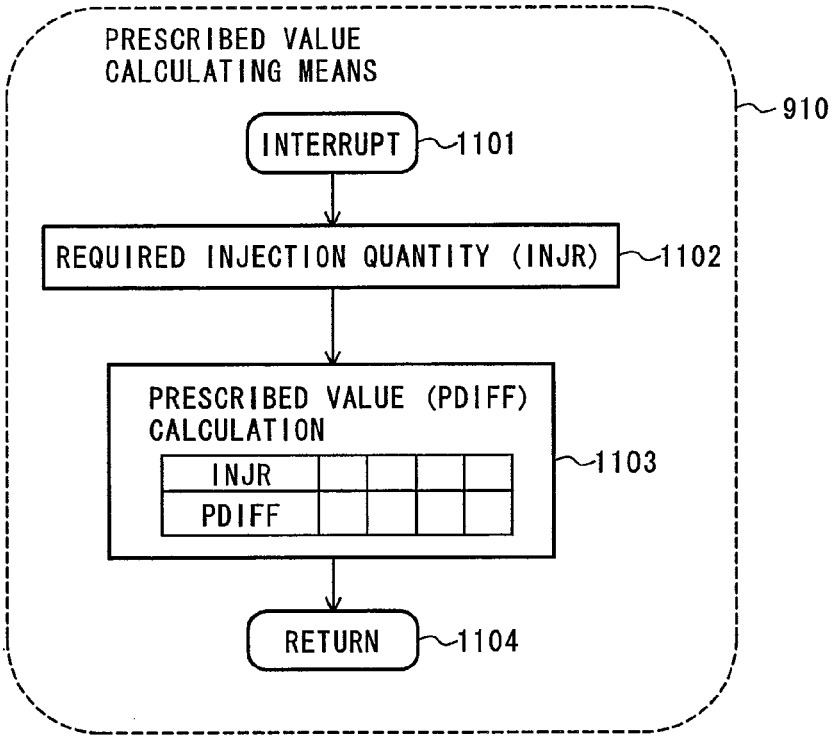
FIG. 11 is a control flowchart according to an embodiment of the present invention.

FIG. 11 illustrates a control flowchart of the prescribed value calculation means 910 according to a second embodiment. Interrupt processing is started at block 1101 and the required injection quantity (INJR) of the internal combustion engine is read at block 1102.

Prescribed values (PDIFF) are calculated at block 1103. The prescribed values (PDIFF) are subjected to table retrieval for example. Injector required energization time can be calculated by reading the required injection quantity. The prescribed values (PDIFF) are set so that short energization time may not make the injection quantity unstable. The energization time is more liable to be short as the required injection quantity is smaller. Thus, the injection quantity unstable region is avoided by setting the prescribed values (PDIFF) at larger values with the less required injection quantity.

Figure 15:
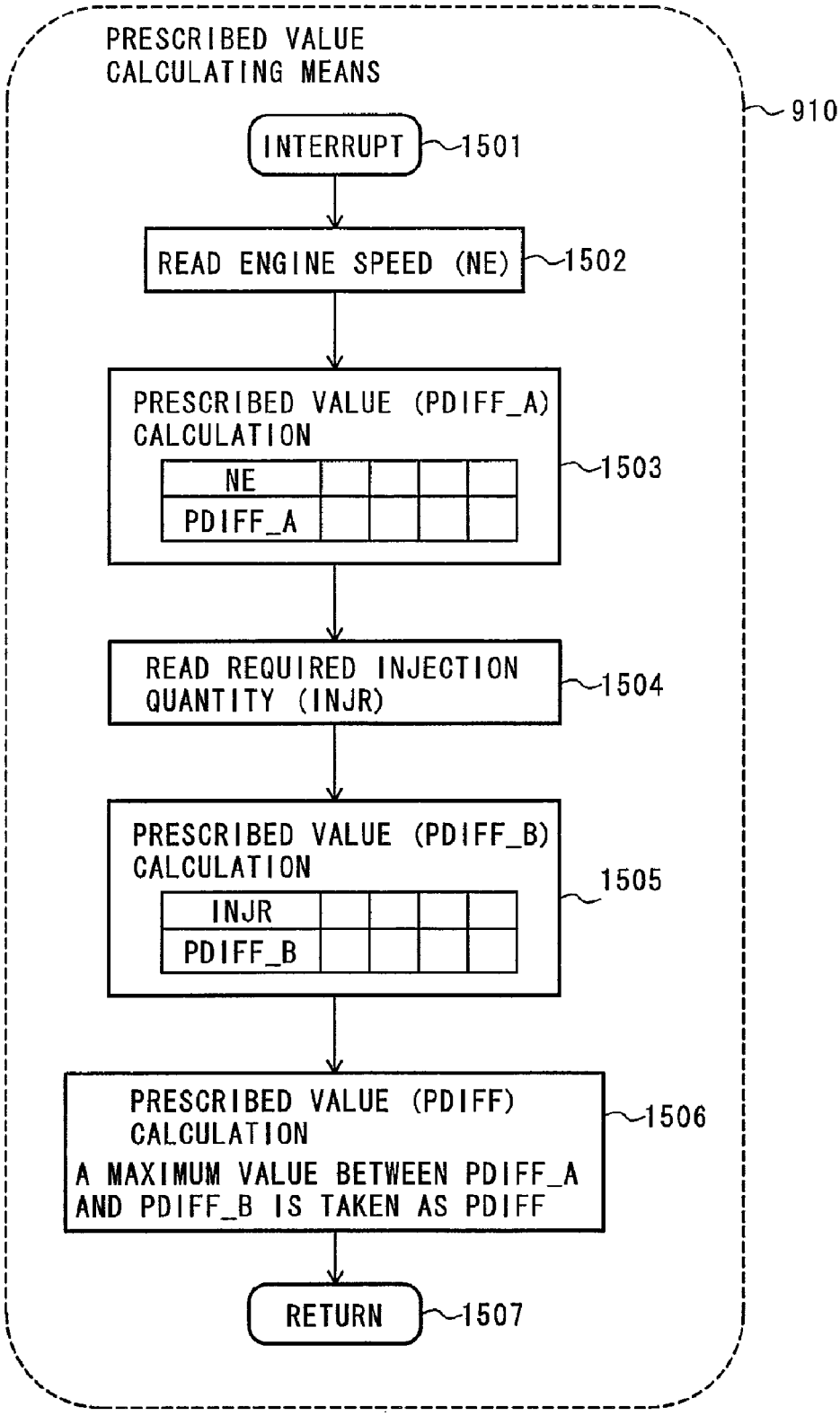
FIG. 15 is a control flowchart according to an embodiment of the present invention.

A combination of the embodiment shown in FIG. 10 with the embodiment shown in FIG. 11 can calculate prescribed values (PDIFF) used to more reliably avoid the unstable area (see FIG. 15).

At block 905, a determination is made whether or not the following expression 1 is satisfied:

Maximum possible pressure for injector opening(INJLIMP)−Prescribed value(PDIFF)<=Fuel pressure(FUELP) (Expression 1)

If expression 1 is satisfied, fuel cut is performed at block 906. The fuel cut of the present invention does not intend to limit the upper limit of the engine speed but aims to prevent misfiring by reliably avoiding the injection quantity unstable region using fuel pressure as information.

Figure 12:
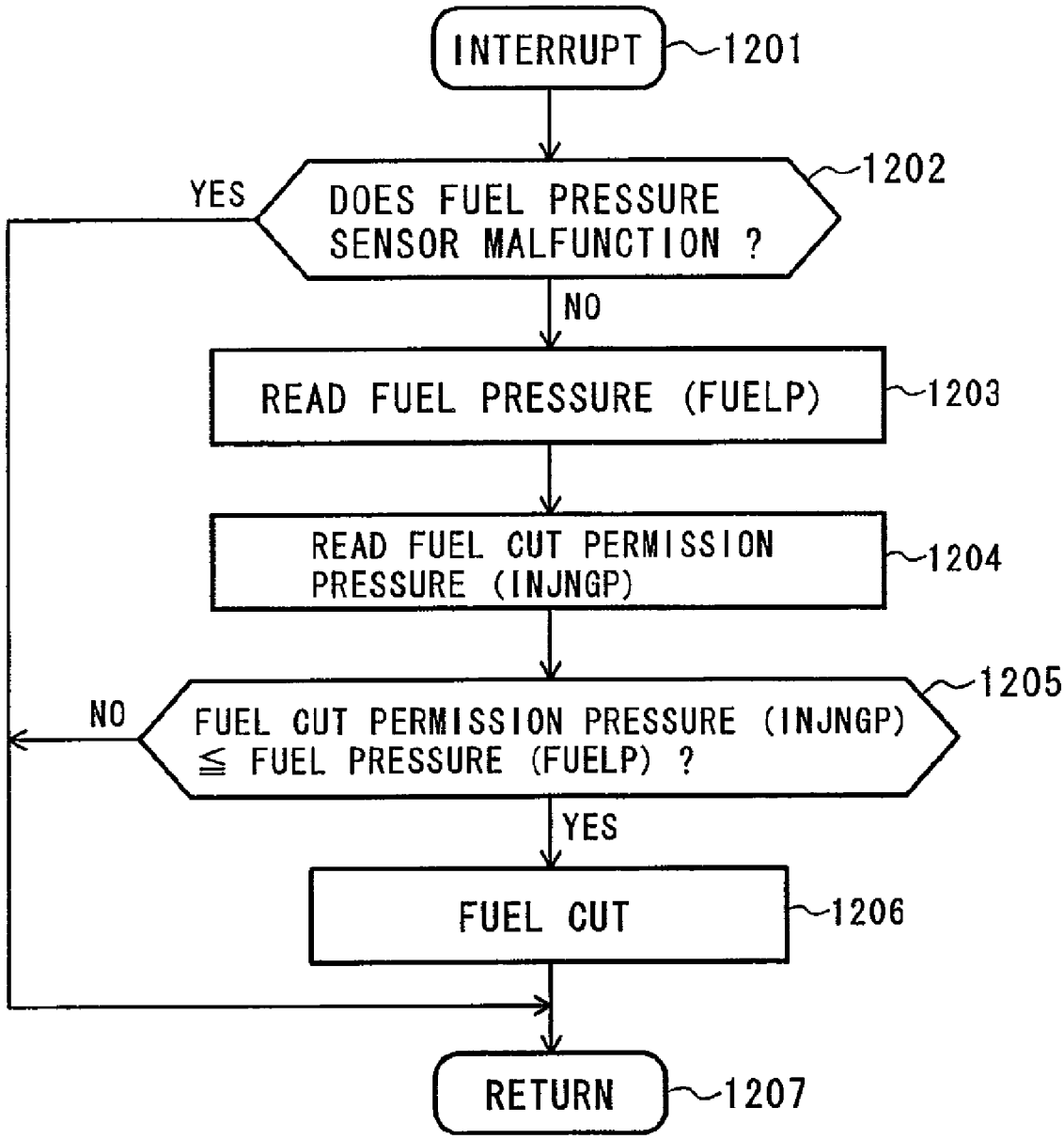
FIG. 12 is a control flowchart according to an embodiment of the present invention.

FIG. 12 illustrates a control flowchart for the control apparatus of the internal combustion engine according to a second embodiment of the present invention. Interrupt processing is started at block 1201. The interrupt processing may be done based on temporal synchronization such as, e.g., every 10 ms or on a rotational period such as, e.g., every 180 degrees of crank angle.

At block 1202, malfunction of the fuel pressure sensor provided in the common rail is detected. The malfunction detected at block 1202 is such that fuel pressure is recognized as higher than the actual fuel pressure. The purpose of block 1202 is to prevent engine stall resulting from the fact that fuel pressure is erroneously recognized due to the malfunction of the fuel pressure sensor so that the fuel cut relating to the present invention described later is permitted.

If it is determined that the fuel pressure sensor is good at block 1202, fuel pressure (FUELP) is read at block 1203 and fuel cut permission pressure (INJNGP) is read at block 1204. In order to avoid the injection quantity unstable area immediately before maximum possible pressure for injector closing, the fuel cut permission pressure (INJNGP) is set to a maximum pressure where the injection quantity does not become unstable during high fuel pressure. The fuel cut permission pressure (INJNGP) may be made variable according to the operation state for the same reason as those of the embodiments shown in FIGS. 10 and 11.

At block 1205, a determination is made whether or not the following expression 2 is satisfied:

Fuel cut permission pressure(INJNGP)<=Fuel pressure(FUELP) (Expression 2)

If expression 2 is satisfied, fuel cut is performed at block 1206.

Figure 13:
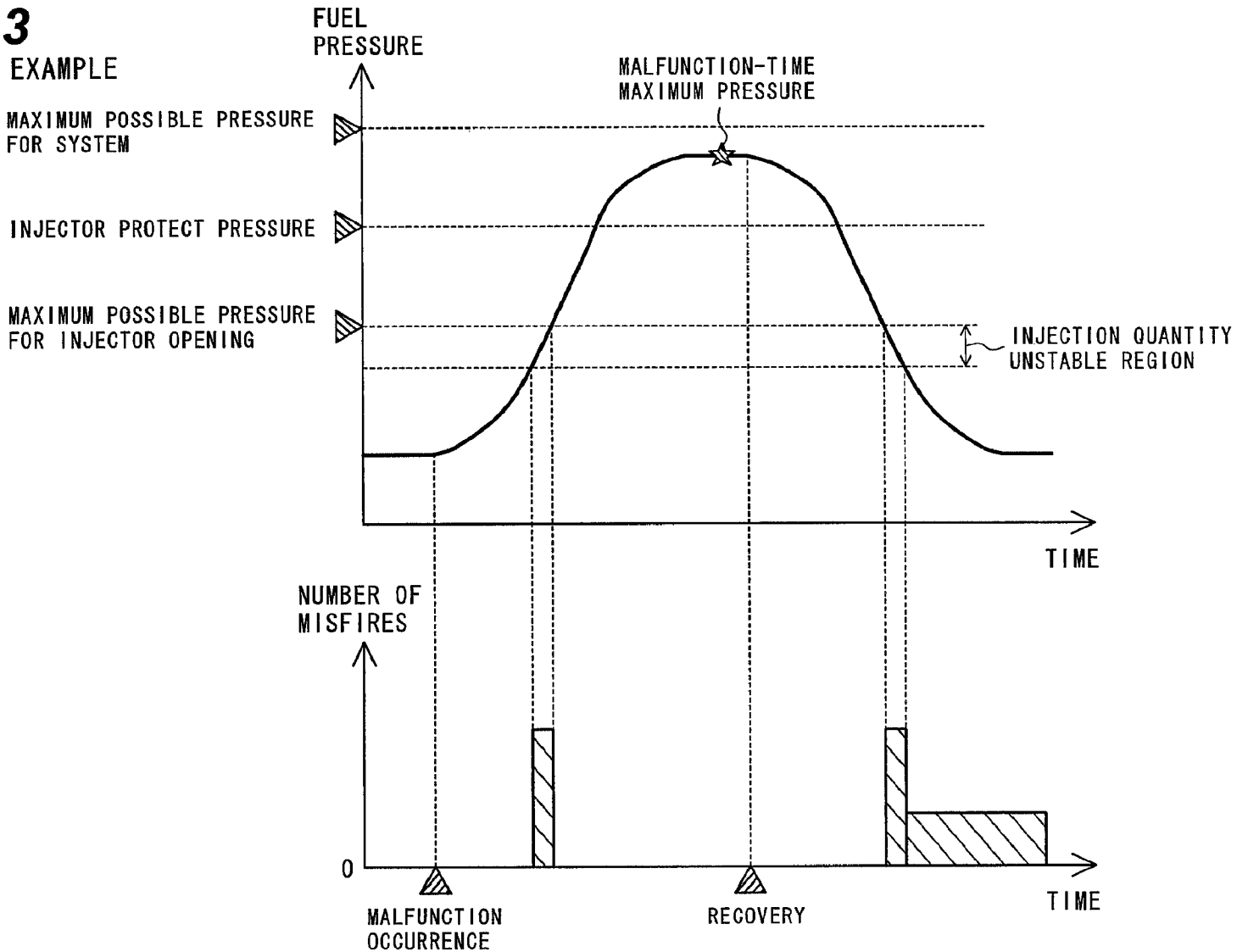
FIG. 13 is a basic timing chart of a conventional example.
Figure 14:
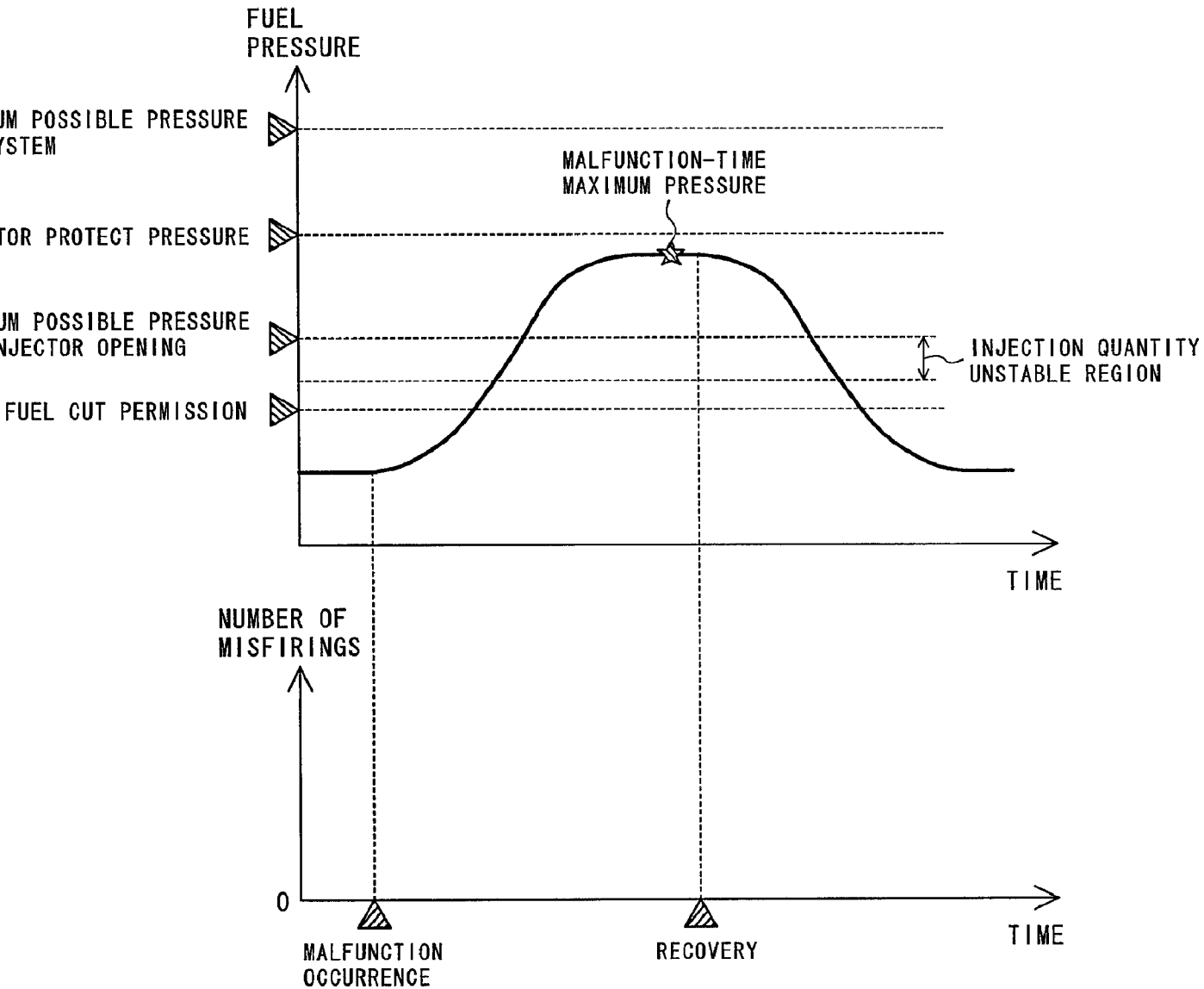
FIG. 14 is a basic timing chart of an embodiment of the present invention.

The effects of the present invention are described with reference to FIGS. 13 and 14. FIG. 13 is a time chart for fuel pressure and the number of misfirings in the case where malfunction occurs in a high-pressure fuel supply apparatus or a control apparatus thereof according to a conventional example. FIG. 14 is a time chart for fuel pressure and the number of misfirings in the case where malfunction occurs in the high-pressure fuel supply apparatus or the control apparatus thereof according to the present invention.

In FIG. 13, when fuel pressure rises after the occurrence of malfunction, injection is performed in a region which is close to the maximum possible pressure for injector opening and at which a quantity of injection becomes unstable. Thus, lean-misfiring occurs. In addition, since an injector experiences fuel pressure equal to or higher than injector protect pressure, the flow characteristic and spray characteristic of the injector vary after recovery from malfunction so that misfiring occurs.

On the other hand, in FIG. 14 according to the embodiment of the present invention, injection is stopped in a region which is close to the maximum possible pressure for injector opening and at which a quantity of injection becomes unstable. In addition, the maximum fuel pressure is set to the injector protect pressure or lower. Thus, no misfiring occurs, which contributes to stable combustion and to an improvement in emission gas performance.

The embodiments of the present invention have been described in detail thus far. However, the present invention is not limited to the embodiments described above and can variously be altered or modified in design without departing from the spirit of the present invention recited in claims.

What is claimed is:

1. A high-pressure fuel supply apparatus comprising:

a high-pressure fuel supply system for supplying under pressure fuel delivered from a low-pressure fuel pump to a common rail by a high-pressure fuel pump and further supplying the pressurized fuel to an injector for directly injecting the fuel in the common rail into a combustion chamber;

a pressure control valve for controlling pressure in the common rail by returning fuel to a low-pressure side when the pressure increases to a predetermined value or more;

a device for detecting the pressure in the common rail; and a control device for controlling the pressure in the common rail;

wherein, when the high-pressure fuel supply apparatus or a control system of said high-pressure fuel supply apparatus causes malfunction so that the pressure in the common rail increases, a maximum pressure point in the common rail is no higher than a pressure that does not affect at least one of a flow characteristic and a spray characteristic of the injector after recovery from the malfunctioning state.

2. The high-pressure fuel supply apparatus according to claim 1, wherein the pressure that does not affect at least one of the flow characteristic and the spray characteristic of the injector is determined based on a result of giving pressure amplitude to the injector alone.

3. The high-pressure fuel supply apparatus according to claim 1, wherein the maximum pressure point in the common rail is set to no less than a maximum possible pressure for injector opening of the injector.

4. A control apparatus for an internal combustion engine according to claim 1, wherein when the high-pressure fuel supply apparatus or the control system of said high-pressure fuel supply apparatus causes malfunction so that the pressure in the common rail increases, injection by the injector is prohibited if the pressure in the common rail is higher than a prescribed value.

5. The control apparatus for an internal combustion engine according to claim 4, wherein the prescribed value is set to a lower value as engine speed of the internal combustion engine is higher.

6. The control apparatus for an internal combustion engine according to claim 4, wherein the prescribed value is set to a lower value as a required injection quantity of the internal combustion engine is smaller.

7. The control apparatus for an internal combustion engine according to claim 1, wherein when the high-pressure fuel supply apparatus or the control system of said high-pressure fuel supply apparatus causes malfunction to increase the pressure in the common rail, injection by the injector is prohibited at a pressure in the common rail lower than the maximum possible pressure for injector opening of the injector by a prescribed value.

8. The control apparatus for an internal combustion engine according to claim 7, wherein the prescribed value is calculated from engine speed of the internal combustion engine.

9. The control apparatus for an internal combustion engine according to claim 8, wherein the prescribed value is set to a larger value as the engine speed of the internal combustion engine is greater.

10. The control apparatus for an internal combustion engine according to claim 7, wherein the prescribed value is calculated from a required injection quantity of the internal combustion engine.

11. The control apparatus for an internal combustion engine according to claim 10, wherein the prescribed value is set to a greater value as the required injection quantity of the internal combustion engine is smaller.

* * * * *